United States Patent [19]

DoMinh

[11] 4,308,341

[45] Dec. 29, 1981

[54] NON-SILVER IMAGING COMPOSITIONS HAVING IMPROVED SPEEDS AND PROCESSING TEMPERATURES

[75] Inventor: Thap DoMinh, Rochester, N.Y.

[73] Assignee: Eastman Kodak Company, Rochester, N.Y.

[21] Appl. No.: 176,369

[22] Filed: Aug. 8, 1980

[51] Int. Cl.[3] ..... G03C 1/52; G03C 5/24

[52] U.S. Cl. ..... 430/336; 430/340; 430/342; 430/343; 430/341; 430/936; 430/967; 430/177; 430/178; 430/179; 430/151; 430/966

[58] Field of Search ..... 430/336, 338, 340, 341, 430/342, 343, 936, 967, 177, 966, 178, 179, 151

[56] References Cited

PUBLICATIONS

"Inhibiting Image Formation with Co(III) complexes," W079/00448, pp. 1–62, Jul. 26, 1979.

*Research Disclosure,* vol. 184, Publication No. 18436, Aug. 1979.

*Research Disclosure,* vol. 126, Publication No. 12617, Oct. 1974.

*Research Disclosure,* vol. 158, Publication No. 15874, Jun. 1977.

*Research Disclosure,* vol. 200, Publication No. 20020, Dec. 1980.

*Primary Examiner*—Won H. Louie, Jr.

*Attorney, Agent, or Firm*—Dana M. Schmidt

[57] ABSTRACT

There are disclosed an imaging composition, element and method featuring an aromatic dialdehyde that reacts with an exposure-generated amine to form a dye. The photographic speed of the reaction is improved by incorporating into the composition an imide capable of providing an

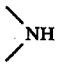

moiety when heated.

33 Claims, No Drawings

NON-SILVER IMAGING COMPOSITIONS HAVING IMPROVED SPEEDS AND PROCESSING TEMPERATURES

(1) Field of the Invention

This invention relates to a non-silver imaging composition and element which contain an aromatic dialdehyde as a dye-forming component of the imaging composition, and a method of using such a composition and element to form an image.

(2) Background of the Invention

Non-silver imaging compositions relying upon the conversion of cobalt(III) complexes to cobalt(II) and released ligands are described in a number of publications, for example, *Research Disclosure*, Vol. 184, Publication No. 18436 dated August, 1979, published by Industrial Opportunities Ltd., Homewell, Havant, Hampshire, P09 1EF United Kingdom. In one form, e.g., Examples 8 and 9 thereof, a quinone photoreductant and o-phthalaldehyde, hereinafter "phthalaldehyde", are included, in one or more layers, with the cobalt(III) complex. Upon exposure to light, the photoreductant forms a reducing agent for the complex. Upon development by heat, the ligands of the complex are released to produce, with the phthalaldehyde, a black dye.

Such imaging compositions have been found to be highly useful, particularly for contact duplicating. However, the required thermal development frequently must exceed 135° C., and the speed of the composition requires exposures of at least $10^6$ ergs/cm$^2$. The relatively high temperature of thermal development requires either a high-temperature support or special processing steps to prevent undesirable processing dimensional changes from occurring in the element because of high temperatures used during processing. A speed that requires an exposure of $10^6$ ergs/cm$^2$ prevents the composition from having a wide range of applications.

What is desired, then, is an imaging composition that relies upon a material such as a cobalt(III) complex, a photoreductant, and phthalaldehyde as dye formers, that also has enhanced speed and reduced development. temperatures requirements. For example, an increase in speed to a level that requires an exposure of only $10^3$ ergs/cm$^2$ means that X-ray exposures can be used as well as more conventional exposures.

SUMMARY OF THE INVENTION

In accordance with the present invention, there are advantageously featured an improved imaging composition and element, as well as an imaging method, that provide dye formation by the combination of an aromatic dialdehyde and amines. The dye formation occurs at higher speeds and lower processing temperatures then were available for this kind of imaging composition, element and method prior to this invention.

It is a related advantageous feature of the invention that such an imaging element is less expensive to manufacture because the lower processing temperature requirements permits the use of less costly supports.

It is yet another related advantageous feature that the composition and imaging elements of the invention can be used to obtain X-ray imaging, because of the increased speed.

More specifically, there is provided an imaging composition comprising an energy-activatible material capable of generating amines by reduction; and an aromatic dialdehyde that reacts with the amines to form a dye. The composition is improved by including an imide capable of providing an

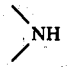

moiety when heated, the imide being present in an amount that is sufficient to provide to the composition, when coated, dried and exposed to light, a speed that is at least 0.15 log E faster than the speed of an identical composition lacking the imide.

An imaging element of the invention comprises the above-mentioned composition disposed in one or more layers on a support.

To initiate the formation of an image, the aforesaid composition or element is exposed to activating Other features of the invention will become apparent upon reference to the following description of the preferred embodiments.

DESCRIPTION OF THE PREFERRED EMBODIMENTS

This invention concerns a composition, an imaging element comprising the composition, and an imaging process using that element or composition. Exposure of the composition to activating energy, such as imagewise exposure to electromagnetic energy followed by exposure to heat, causes a reaction between the following substances of the composition to form a dye: (a) a material capable of generating amines by reduction, such material optionally including a photoreductant that generates a reducing agent in response to the activating energy, and (b) an aromatic dialdehyde. Improved speeds and processing temperatures are obtained by including an imide, as described in the Summary, in the composition. As used herein, "imide" means two acyl groups joined to the amine moiety, that is, a compound a portion of which has the structure

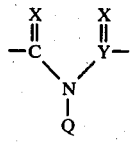

wherein Q is hydrogen or a heat-removable blocking group, the X's are each independently oxygen or sulfur, and Y is carbon or sulfur unless the X bonded thereto is sulfur, in which case Y is carbon. Various groups are useful as the heat-removable blocking group, e.g., any substituent other than alkyl, aryl, hydroxy, alkoxy or aryloxy.

Regarding the composition to which the imide is added, substances (a) and (b) noted above are amply described in the literature. As to substance (a), any material capable of generating amines by reduction, such as through the use of a photoreductant, is useful. Highly preferred are cobalt(III) complexes of the type described in the aforesaid *Research Disclosure*, particularly those that are designated as "thermally stable". That is, any cobalt(III) complex containing releasable amine ligands and which is thermally stable at room temperature will function in this invention. Such complexes on occasion have been described as being "inert". See, e.g., U.S. Pat. No. 3,862,842, Columns 5 and 6. However, the ability of such complexes to remain stable, i.e., retain their original ligands when stored by themselves or in a neutral solution at room temperature until a chemically or thermally initiated reduction to cobalt(II) takes place, is so well known that the term "inert" will not be applied herein.

Such cobalt(III) complexes feature a molecule having a cobalt atom or ion surrounded by a group of atoms or other molecules which are generically referred to as ligands. The cobalt atom or ion in the center of these complexes is a Lewis acid while the ligands, herein described as amine ligands, are Lewis bases. While it is known that cobalt is capable of forming complexes in both its divalent and trivalent forms, trivalent cobalt complexes—i.e., cobalt(III) complexes—are preferably employed in the practice of this invention, since the ligands are relatively tenaciously held in these complexes, and released when the cobalt is reduced to the (II) state.

Most preferably, the cobalt(III) complexes employed in the practice of this invention are those having a coordination number of 6. Many amine ligands are useful with cobalt(III) to form a cobalt(III) complex, including, e.g., methylamine, ethylamine, ammines, and amino acids such as glycinato. As used herein, "ammine" refers to ammonia specifically, when functioning as a ligand, whereas "amine" is used to indicate the broader class noted above.

The cobalt(III) complexes useful in the practice of this invention include those that are neutral compounds entirely free of either anions or cations. As used herein, "anion" refers to a charged species which, in the commonly understood sense of the term, does not include species that are covalently bonded. Useful cobalt(III) complexes also include those having one or more cations and anions as determined by the charge neutralization rule. Useful cations are those which produce readily soluble cobalt(III) complexes, such as alkali metals and quaternary ammonium cations.

Many anions are useful, and those disclosed in the aforesaid *Research Disclosure* are particularly useful.

The following Table I is a partial list of particularly preferred cobalt(III) complexes.

TABLE I hexa-ammine cobalt(III) benzilate
hexa-ammine cobalt(III) perfluorobenzoate
hexa-ammine cobalt(III) thiocyanate
hexa-ammine cobalt(III) trifluoromethane sulfonate
hexa-ammine cobalt(III) trifluoroacetate
hexa-amine cobalt(III) heptafluorobutyrate
chloropenta-ammine cobalt(III) perchlorate
bromopenta-ammine cobalt(III) perchlorate
aquopenta-ammine cobalt(III) perchlorate
bis(methylamine) tetra-ammine cobalt(III) hexafluorophosphate
trinitrotris-ammine cobalt(III)
penta-ammine carbonate cobalt(III) perchlorate
tris(glycinato) cobalt(III)
tris(trimethylenediamine)cobalt(III) trifluoromethanesulfonate
tri(trimethylenediamine)cobalt(III) tetrafluoroborate
bis(ethylenediamine)bisazido cobalt(III) perchlorate
triethylenetetraaminedichloro cobalt(III) trifluoroacetate
aquopenta(methylamine) cobalt(III) nitrate
chloropenta(ethylamine) cobalt(III) pentafluorobutanoate
trinitrotris(methylamine) cobalt(III)
tris(ethylenediamine) cobalt(III) trifluoroacetate
bis(dimethylglyoxime)bispyridine cobalt(III) trichloroacetate
$\mu$-superoxodecamine cobalt(III) perchlorate
trans-bis(ethylenediamine)chlorothiocyanato cobalt(III)perchlorate
trans-bis(ethylenediamine)bisazido cobalt(III) thiocyanate
cis-bis(ethylenediamine)ammineazido cobalt(III) trifluoroacetate
tris(ethylenediamine) cobalt(III) benzilate
trans-bis(ethylenediamine)dichloro cobalt(III) perchlorate
bis(ethylenediamine)dithiocyanato cobalt(III) perfluorobenzoate
triethylenetetraaminedinitro cobalt(III) dichloroacetate
tris(ethylenediamine)cobalt(III) succinate
tris(2,2,2'-bipyridyl)cobalt(III) perchlorate
bis(dimethylglyoxime)chloropyridine cobalt(III) and
bis(dimethylglyoxime)thiocyanatopyridine cobalt(III).

Further description of such complexes can be found in "Inhibition of Image Formation Utilizing Cobalt(III) Complexes". *Research Disclosure*, Vol. 184, August, 1979, Publication No. 18436, the contents of which are expressly incorporated herein by reference.

If the activating energy used to initiate the reaction is electromagnetic energy with wavelengths longer than 300 nm, e.g., light, then the material that generates the amines preferably includes a photoreductant responsive to that energy. Any photoreductant capable of forming a reducing agent for the amine-generating complex, in response to exposure to such activating electromagnetic energy, is useful. The development of the image that is initiated by such exposure preferably occurs by subsequently heating the composition to obtain a more prompt generation of the amines. A variety of useful photoreductants are disclosed, for example, in *Research Disclosure*, Vol. 126, Publication 12617, October, 1974, and U.S. Pat. No. 4,201,588 issued May 6, 1980. The details of both of these documents are expressly incorporated herein by reference. A "photoreductant" is distinguishable from other photoactivators such as spectral sensitizers in that only a photoreductant is responsive to the activating energy even in the absence of a cobalt(III) complex. Thus, the photoreductant itself is exposable, when used in a first layer without the complex, and a second layer of a cobalt(III) complex thereafter placed in contact with the first layer, and preferably heated, causes a reduction of the complex to take place.

Useful photoreductants include disulfides, anthrones, diazonium salts, and quinones. The quinones are particularly preferred. Preferably, a source of labile hydrogen atoms is also present either as a separately-added adjuvant such as is described in Paragraph II(c) of the last-named *Research Disclosure*, or as labile hydrogen atoms incorporated into the photoreductant in a form that increases the speed of the complex reduction, upon exposure. Incorporated hydrogen atom photoreductants are also described in the last-named *Research Disclosure*.

The quinones which are particularly useful as photoreductants include ortho- and para-benzoquinones and ortho- and para-naphthoquinones, phenanthrenequinones and anthraquinones. The quinones may be unsubstituted or incorporate any substituent or combination of substituents that do not interfere with the conversion of the quinone to the corresonding reducing agent. A variety of such substituents are known to the art and include, but are not limited to, primary, secondary and tertiary alkyl, alkenyl and alkynyl, aryl, alkoxy, aryloxy, alkoxyalkyl, acyloxyalkyl, arloxyalkyl, aroyloxyalkyl, aryloxyalkoxy, alkylcarbonyl, carboxy, primary and secondary amino, aminoalkyl, amidoalkyl, anilino, piperindino, pyrrolidino, morpholino, nitro, halide and other similar substituents. Aryl substituents are preferably phenyl substituents. Alkyl, alkenyl and alkynyl substituents, whether present as sole substituents or present in combination with other atoms, preferably contain about 20 or fewer (preferably 6 or fewer) carbon atoms.

The most preferred photoreductants presently are the internal hydrogen source quinones; that is, quinones incorporating labile hydrogen atoms as described above. These quinones are more easily photoreduced than quinones which do not incorporate labile hydrogen atoms.

Further details and a list of various quinone photoreductants of the type described above are set forth in the aforesaid *Research Disclosure*, Volume 126, October, 1974, Publication No. 12617. Still others which are useful include 2-isopropoxy-3-chloro-1,4-naphthoquinone and 2-isopropoxy-1,4-anthraquinone.

Activating electromagnetic energy of wavelengths less than 300 nm, e.g., X-rays, is also useful as an exposure mode. In such a case, a photoreductant is not a necessary part of the amine-generating material and can be omitted.

Still other forms of activating energy are useful, such as energetic particle radiation, for example, electron-beam radiation.

The aromatic dialdehyde of the invention is a reducing agent precursor in that it reacts to form, in the presence of amines, a reducing agent for the cobalt(III) complex, and thereafter, a dye. Any such dialdehyde is useful.

o-Phthaladehyde, hereinafter phthalaldehyde, is the currently preferred dialdehyde reducing agent precursor and dye former of this invention. Phthalaldehyde appears to undergo the following reaction, in the presence of the released amines, to provide amplification in the exposed areas as well as a dye (B):

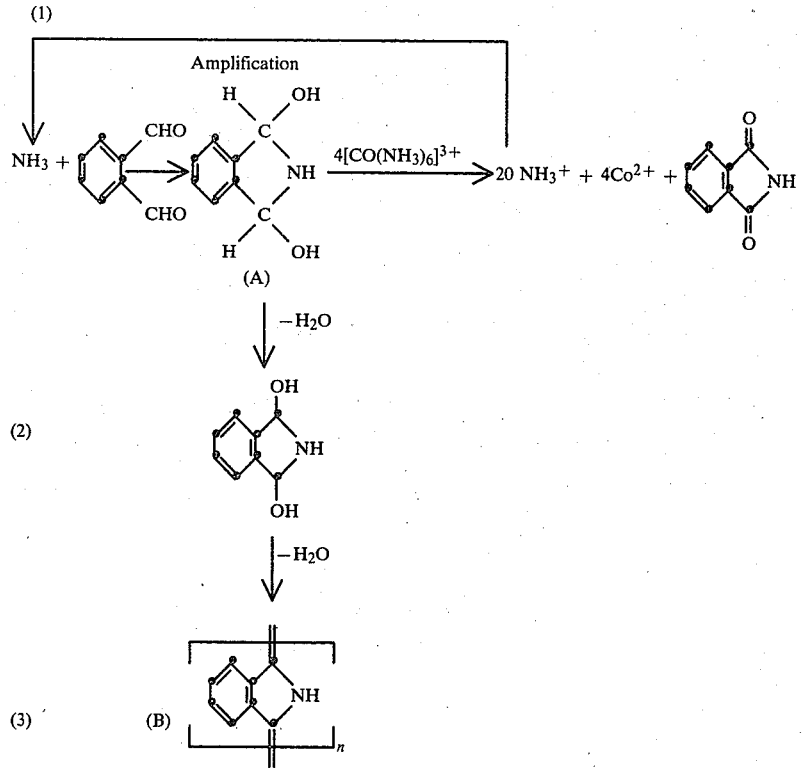

Further details of the phthaladehyde reaction are set forth in DoMinh et al, "Reactions of Phthalaldehyde with Ammonia and Amines," *J. Org. Chem.*, Vol. 42, Dec. 23, 1977, p. 4217.

Optionally, other dye formers are incorporatable in the same layer or an adjacent layer, provided they are responsive to either the released amines or the cobalt(II) resulting from the reduction reaction. Examples are described in the aforesaid *Research Disclosure* Publication No. 12617.

In accordance with the invention, increased speeds and lowered processing temperatures result from the addition to the composition of an imide that is either already in the

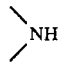

form, or produces that form in situ upon heating. Preferred imides are those represented by the structural formula

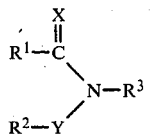

wherein $R^1$ and $R^2$ are each individually alkyl of 1 to 5 carbon atoms, such as methyl, ethyl, propyl and the like, or together $R^1$ and $R^2$ comprise the necessary atoms to complete 1, 2 or 3 rings containing from 5 to 12 nuclear atoms, such "rings" being defined to include saturated or unsaturated, and substituted or unsubstituted rings, for example, pyrrolyl, isoindolyl, pyrazolidyl, benzopyrazolidyl, etc.;

$R^3$ is hydrogen or a heat-removable blocking group that allows

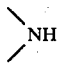

to form in situ, such as $—Si(R^1)_3$, $—CONHR^1$ and $—COR^1$;

Y is

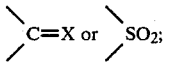

and

X is oxygen or sulfur. The substituents on the substituted ring(s) formed by $R^1$ and $R^2$ are preferably electron-accepting substituents, such as nitro, chloro, phenyl and the like, for maximum speed increases. However, even substituents on the ring(s) that are not electron-accepting, such as alkoxy or alkyl, have been found to produce a speed increase.

The following Table II is a list of some of the imides useful in the invention. The first eleven are particularly preferred because they produce the greatest increase in speed.

TABLE II succinimide
2-methylsuccinimide
phthalimide
dithiouracil
5-methyl-5-n-pentylhydantoin
5,5-dimethyloxazolone
4-nitrophthalimide
3-nitrophthalimide
3-(p-benzylsulfonamido)phthalimide
2,3,4,5-tetrachlorophthalimide
diphenylhydantoin
maleimide
glutarimide
pyromellitimide
N-(trimethylsilyl)phthalimide
hydantoin
diacetamide
3-methylphthalimide
4-n-octyloxyphthalimide A mixture of two imides can also be used.

The following imides have been found to be ineffective, when used in the amounts hereinafter described. That is, they fail to increase the speed of the composition by at least 0.15 log E: N-methylphthalimide; N-ethylphthalimide; N-hydroxy-1,8-naphthalimide; N-hydroxyphthalimide; and N-methoxyphthalimide.

As used herein, "speed" refers to photographic speed, and the speed increases of the invention provide either improved image densities for comparable exposure or comparable densities for reduced exposure levels. Although the mechanism is not completely understood, it is believed that the speed increase results from a deamination of the cobalt complex nucleus, when using cobalt(III) complexes as the reducible material, by the imine anion to produce additional ammonia that reacts with unreacted phthalaldehyde to form additional reducing agent, compound (A) of reaction (1) above, for the remaining cobalt(III) complexes.

Certain materials are optionally added. For example, if the composition is to be coated as a film on a support, as opposed to being sprayed into filter paper, a binder is desirable. Any binder compatible with cobalt(III) complexes is useful, for example, the binders listed in the aforesaid Publication No. 12617 of *Research Disclosure,* especially paragraph I(D). Typical of such binders are acetates, cellulose compounds, vinyl polymers, polyacrylates and polyesters. In addition, useful binders are selected from those that maximize the maximum neutral densities produced during exposure and development. Highly preferred examples of such binders include certain polysulfonamides, for example, poly(ethylene-co-1,4-cyclohexylenedimethylene-1-methyl-2,4-benzenedisulfonamide), poly(ethylene-co-hexamethylene-1-methyl-2,4-benzenedisulfonamide), and poly(methacrylonitrile).

The proportions of the non-binder reactants forming the composition and/or the imaging element vary, depending upon which materials are being used. The amount of imide to be used depends upon the particular imide and the desired photographic effect. Greater amounts of imide, up to a certain level, tend to produce greater increases in speeds. Amounts greater than said certain level, while not consistently demonstrating still greater speeds, have been found to produce a slight decrease in the required processing temperature. Thus, a useful range of imides is from about 0.5 mmole (hereinafter mM)/$dm^2$ to about 20 mM/$dm^2$, the most preferred amounts being between about 2.0 and about 5.0 mM/$dm^2$.

A preferred range of coating coverage of reducible material such as a cobalt(III) complex is between about 5 and about 50 mg/$dm^2$, of photoreductant is between about 40 and about 320 mg/$dm^2$, and of aromatic dialdehyde is between about 1 and about 5 g/$dm^2$.

Preferably, solutions are coated onto the support by such means as whirler coating, brushing, doctor-blade coating, hopper coating and the like. Thereafter, the solvent is evaporated. Other exemplary coating procedures are set forth in the *Product Licensing Index,* Volume 92, December 1971, Publication No. 9232, at page 109, and in *Research Disclosure,* December 1978, Item No. 17643, both of which are published by Industrial Opportunities Limited, Homewell, Havant Hampshire P091EF, United Kingdom. Addenda such as coating aids and plasticizers are incorporatable into the coating composition.

The composition of the invention is preferably disposed in one or more layers on a support, to form an imaging element. Most preferred is the single layer format. In addition, a useful element features two layers on the support, as described in, for example, the aforesaid *Research Disclosure,* Publication No. 18436, FIG. 1*c*. In such a multi-layered element, the first layer (in contact with the support) comprises a binder, the reducible material such as cobalt(III) complex, the photoreductant, and the imide. The second, outermost layer covering the first layer comprises a binder and phthalaldehyde. Or alternatively, the first layer comprises a binder and a photoreductant. Following imagewise exposure to light, a second layer of a binder, a cobalt(III) complex, phthalaldehyde, and an imide is superimposed in contact with the first layer and heated.

In certain instances, an overcoat layer provides improved handling characteristics and helps to retain otherwise volatile components. Useful examples include gelatin overcoats cross-linked with an agent, such as a 5-weight percent aqueous solution of hexamethoxymethyl melamine, and various acrylamide-containing copolymers such as poly(acrylamide-co-N-vinyl-2-pyrrolidone-co-2-acetoacetoxyethyl methacrylate) (50:45 wt. percent), as are more fully described for example in commonly-owned U.S. Application Ser. No. 971,460 filed on Dec. 20, 1978 by Adin, entitled "Inhibition of Image Formation Utilizing Cobalt(III) Complexes", the details of which are expressly incorporated herein by reference.

The image-forming composition described above is exposed imagewise, preferably as a coated element, to a suitable exposure device, for example an IBM Microcopier IID TM, and the development of the image is completed in a rapid manner by heating the element to a temperature of between about 100° and about 135° C., depending on the amount of imide and the type of imide present. Lower development temperatures are possible with the invention, a marked improvement compared to the temperatures required without the imide present. Preferred heating times range from about 1 to about 30 seconds. Longer heating times can be used but are less practical. The heating step is preferred whether or not a photoreductant is included in the amine-generating material.

The following examples are included for a further understanding of the invention.

EXAMPLES 1-7

The following dope was prepared:

| | |
|---|---|
| Poly(ethylene-co-1,4-cyclohexylenedimethylene-1-methyl-2,4-benzenedisulfonamide) (binder) (15 wt/wt percent in acetone) | 10.0 g |
| Hexamminecobalt (III) trifluoroacetate | 0.25 g (0.50 mM) |
| Phthalaldehyde | 0.40 g (3.0 mM) |
| 4-Isopropoxy-1,4-naphthoquinone | 0.015 g (0.07 mM) |
| Imide of Table III | (0.20 mM) |

Handcoatings were made by coating the above on a poly(ethylene terephthalate) support at about 100 microns wet thickness at 26°-27° C. and drying at 60° C. for 10 minutes. All coatings were then overcoated with poly(acrylamide-co-N-vinyl-2-pyrrolidone-co-2-acetoacetoxyethyl methacrylate) (50:45 wt. percent) and dried similarly. Samples of each coating were exposed for the same length of time on an IBM Microcopier IID TM exposing apparatus through a 14-step wedge and processed by heating for 5 seconds face up on a hot block set at 135° C. The change in speed, measured as ΔLog E relative to the control, is recorded in Table III.

TABLE III

| Example | Imide | (Imide Structure) | Relative Speed (Δ Log E) | Required Exposure ergs/cm$^2$ |
|---|---|---|---|---|
| Control | none | — | 0 | $1.9 \times 10^5$ |
| 1 | Succinimide | 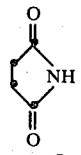 | 1.80 | $3 \times 10^3$* |
| 2 | 2-Methylsuccinimide | 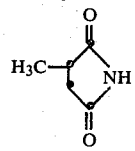 | 1.80 | $3 \times 10^3$* |
| 3 | Maleimide | 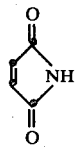 | 1.80 | $3 \times 10^3$* |
| 4 | Glutarimide | 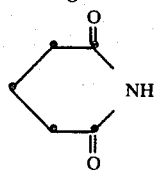 | 0.30 | — |
| 5 | Phthalimide | 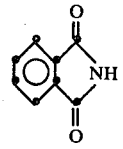 | 1.80 | $3 \times 10^3$* |
| 6 | Pyromellitimide | 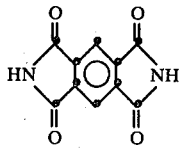 | 1.50 | — |
| 7 | Dithiouracil | 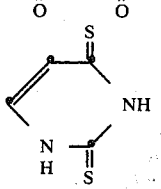 | 1.80 | $3 \times 10^3$* |

*This represents the reduced exposure level that would be required to produce, for this example, a speed that is identical to the relative speed of zero assigned to the control.

The control gave a neutral D-max of about 3.0 but required heating for 5 seconds at 135° C. All of the imide coatings produced about the same D-max but gave much higher photographic speeds.

EXAMPLE 8—Effect of Concentration

The procedure of Example 5 was repeated, but at varying concentrations of imide. The effective of concentration of phthalimide upon the photographic speed and the processing temperature required to develop the image of the composition is shown in Table IV.

TABLE IV

| Phthalimide Level (mM) | Speed (Log E) | Processing Temperature (°C.) |
|---|---|---|
| 0 | 0 | 135 |
| 0.10 | 1.3 | 135 |
| 0.20 | 1.9 | 130 |
| 0.50 | 1.6 | 110 |
| 1.0 | 1.9 | 110 |
| 1.5 | 2.2 | 110 |

EXAMPLES 9–13—Other Imides

The procedure of Example 1 was repeated, using however the imides of Table V. The speed results are indicated in the Table.

TABLE V

| Example | Imide | (Imide Structure) | Δ Log E Speed |
|---|---|---|---|
| Control | none | — | 0 |
| 9 | Diacetamide | $CH_3C(=O)-NH-C(=O)CH_3$ | 0.15 |
| 10 | 3-Methyl-phthalimide | 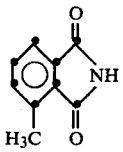 | 0.25 |
| 11 | 4-n-Octyloxy-phthalimide | 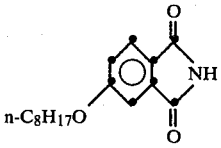 | 0.45 |
| 12 | 5-Methyl-5-n-pentyl-hydantoin | 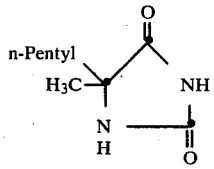 | 1.80 |
| 13 | 5,5-Dimethyl-oxazolidine-2,4-dione | 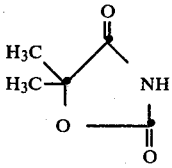 | 1.80 |

EXAMPLE 14—X-ray Exposure

Coatings were prepared by the procedure of Example 1, except that no photoreductant was present. A control was prepared that lacked the imide (succinimide). The coatings were then exposed imagewise through a lead test object, for 10–40 sec at a distance of 6 inches, to an X-ray source operating at 50 kilovolts and 40 mA. Processing was carried out by heating the exposed film for 5 sec on a hot block set at 125° C. No image was found for the control. In Example 14, a strong black image on clear background (density above 3.0) was found. The minimum dosage for this image formation was calculated to be 3–4 X $10^3$ Roentgen/$cm^2$.

The invention has been described in detail with particular reference to preferred embodiments thereof, but it will be understood that variations and modifications can be effected within the spirit and scope of the invention.

What is claimed is:

1. In an imaging composition comprising an energy-activatible material capable of generating amines by reduction, said material including a source of said amines that releases said amines when reduced, and a photoreductant capable of producing a reducing agent for said source when exposed to activating energy; and an aromatic dialdehyde that reacts with said amines to form a dye;

the improvement wherein said composition further includes an imide capable of providing an NH moiety when heated, said imide being present in an amount sufficient to provide to said composition, when coated, dried and exposed to light, a speed that is at least 0.15 log E faster than the speed of an identical composition lacking said imide.

2. A composition as defined in claim 1, wherein said imide is a cyclic imide.

3. A composition as defined in claim 1 or 2, wherein said dialdehyde is o-phthalaldehyde.

4. A composition as defined in claim 1 or 2, wherein said material comprises a reducible cobalt(III) complex containing releasable amine ligands.

5. A composition as defined in claim 1 or 2, wherein said material comprises a reducible cobalt(III) complex containing releasable amine ligands and a photoreductant responsive to electromagnetic energy of longer than 300 nm wavelengths to form a reducing agent for said complex.

6. A composition as defined in claim 5, wherein said photoreductant incorporates labile hydrogen atoms capable of increasing the speed of the reduction of said material.

7. A composition as defined in claim 1 or 2, wherein said imide is succinimide.

8. A composition as defined in claim 1 or 2, wherein said imide is 2-methylsuccinimide.

9. A composition as defined in claim 1 or 2, wherein said imide is phthalimide.

10. A composition as defined in claim 1 or 2, wherein said imide is 5-methyl-5-n-pentylhydantoin.

11. A composition as defined in claim 1 or 2, wherein said imide is 5,5-dimethyl oxazolone.

12. A composition as defined in claim 1 or 2, wherein said imide is dithiouracil.

13. A composition as defined in claim 1 or 2, wherein said imide is diphenylhydantoin.

14. In an imaging composition comprising an energy-activatible material capable of generating amines by reduction, said material including a source of said amines that releases said amines when reduced, and a photoreductant capable of producing a reducing agent for said source when exposed to activating energy; and an aromatic dialdehyde that reacts with said amines to form a dye;

the improvement wherein said composition further includes an imide represented by the structural formula

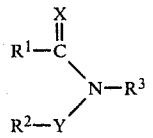

wherein $R^1$ and $R^2$ are each individually alkyl of 1 to 5 carbon atoms, or together comprise the atoms necessary to complete 1, 2 or 3 rings containing from 5 to 12 nuclear atoms, $R^3$ is hydrogen or a heat-removable blocking group;

Y is

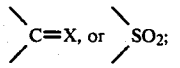

and

X is O or S;

said imide being present in an amount sufficient to provide to said composition, when coated, dried and exposed to light, a speed that is at least 0.15 log E faster than the speed of an identical composition lacking said imide.

15. A composition as defined in claim 14, wherein said imide is a cyclic imide.

16. A composition as defined in claim 14 or 15, wherein said dialdehyde is o-phthalaldehyde.

17. A composition as defined in claim 14 or 15, wherein said material is a reducible cobalt(III) complex containing releasable amine ligands the release of which is initiated by activating radiation.

18. A composition as defined in claim 14 or 15, wherein said material comprises a reducible cobalt(III) complex containing releasable amine ligands and a photoreductant responsive to electromagnetic energy of longer than 300 nm wavelengths to form a reducing agent for said complex.

19. A composition as defined in claim 18, wherein said photoreductant incorporates labile hydrogen atoms capable of increasing the speed of the reduction of said material.

20. A composition as defined in claim 14 or 15, wherein said imide is succinimide.

21. A composition as defined in claim 14 or 15, wherein said imide is 2-methylsuccinimide.

22. A composition as defined in claim 14 or 15, wherein said imide is phthalimide.

23. A composition as defined in claim 14 or 15, wherein said imide is 5-methyl-5-n-pentylhydantoin.

24. A composition as defined in claim 14 or 15, wherein said imide is 5,5-dimethyl oxazolone.

25. A composition as defined in claim 14 or 15, wherein said imide is diphenylhydantoin.

26. In an imaging composition comprising a reducible cobalt(III) complex containing releasable amine ligands the release of which is initiated by activating radiation, a photoreductant capable of producing a reducing agent for said complex when exposed to said activating radiation, and o-phthalaldehyde;

the improvement wherein said composition further includes an imide selected from the group consisting of succinimide; 2-methylsuccinimide; phthalimide; dithiouracil; 5-methyl-5-n-pentylhydantoin; 5,5-dimethyloxazolidine-2,4-dione; 4-nitrophthalimide; 3-nitrophthalimide; 3-(p-benzylsulfonamido)phthalimide; 2,3,4,5-tetrachlorophthalimide; and diphenylhydantoin;

said imide being present in an amount sufficient to provide to said composition, when coated, dried and exposed to light, a speed that is at least 0.15 log E faster than the speed of an identical composition lacking said imide.

27. A composition as defined in claim 1, 2, 14, 15, or 26, and further including a support on which said composition is disposed as one or more layers, to form an imaging element.

28. In a method of forming an image comprising imagewise exposing to activating energy a composition comprising a material capable of generating amines by reduction, said material including a source of said amines that releases said amines when reduced and a photoreductant capable of producing a reducing agent for said source when exposed to activating energy, and an aromatic dialdehyde that reacts with said amines to form a dye; and thereafter heating said composition;

the improvement wherein said composition further includes an imide capable of providing an

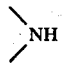

moiety when heated, said imide being present in an amount sufficient to provide to said composition, when coated, dried and exposed to light, a speed that is at least 0.15 log E faster than the speed of an identical composition lacking said imide.

29. A method as defined in claim 28, wherein said exposing step comprises exposing said composition to X-ray radiation.

30. A method as defined in claim 28, wherein said composition further includes a photoreductant responsive to electromagnetic energy of longer than 300 nm wavelengths and wherein said exposing step comprises exposing said composition to light radiation.

31. A method of increasing the speed of a radiation image-forming composition comprising an energy-activatible material capable of generating amines by reduction, said material including a source of said amines that releases said amines when reduced, and a photoreductant capable of producing a reducing agent for said source when exposed to activating energy; and an aromatic dialdehyde that reacts with said amines to form a dye, said method comprising the step of adding to said composition an imide capable of providing an

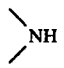

moiety when heated, said imide being present in an amount sufficient to provide to said composition, when coated, dried and exposed to light, a speed that is at least 0.15 log E faster than the speed of an identical composition lacking said imide.

32. A method as defined in claim 31, wherein said composition is useful with X-ray radiation.

33. A method as defined in claim 31, wherein said imide is represented by the structural formula

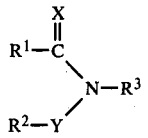

wherein $R^1$ and $R^2$ are each individually alkyl of 1 to 5 carbon atoms, or together comprise the atoms necessary to complete 1, 2 or 3 rings containing from 5 to 12 nuclear atoms, $R^3$ is hydrogen or a heat-removable blocking group;

Y is $$\diagdown C{=}X, \text{ or } \diagdown SO_2;$$

and

X is O or S.

* * * * *

UNITED STATES PATENT AND TRADEMARK OFFICE

CERTIFICATE OF CORRECTION

PATENT NO. : 4,308,341

DATED : December 29, 1981

INVENTOR(S) : Thap DoMinh

It is certified that error appears in the above-identified patent and that said Letters Patent are hereby corrected as shown below:

Col. 12, line 11 reading "NH" should read --$\geq$NH --.

Signed and Sealed this

*Tenth* Day of *August 1982*

[SEAL]

*Attest:*

GERALD J. MOSSINGHOFF

*Attesting Officer*

*Commissioner of Patents and Trademarks*